US006501431B1

(12) United States Patent
Irion, II et al.

(10) Patent No.: US 6,501,431 B1
(45) Date of Patent: Dec. 31, 2002

(54) METHOD AND APPARATUS FOR INCREASING BANDWIDTH OF A STRIPLINE TO SLOTLINE TRANSITION

(75) Inventors: James McGlathery Irion, II, Plano, TX (US); R. Thomas Dover, Prosper, TX (US); Richard E. Hodges, Houston, TX (US); Allan R. Logan, Highland Village, TX (US); John C. Ehmke, Garland, TX (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/946,848

(22) Filed: Sep. 4, 2001

(51) Int. Cl.[7] ..... H01Q 13/08
(52) U.S. Cl. ..... 343/767; 343/768
(58) Field of Search ..... 343/767, 768, 343/700 MS, 795, 772, 786, 770, 829

(56) References Cited

U.S. PATENT DOCUMENTS

| | | | | |
|---|---|---|---|---|
| 4,843,403 A | | 6/1989 | Lalezari et al. | 343/767 |
| 4,853,704 A | | 8/1989 | Diaz et al. | 343/767 |
| 5,036,335 A | | 7/1991 | Jairam | 343/767 |
| 5,081,466 A | | 1/1992 | Bitter, Jr. | 343/767 |
| 5,220,330 A | * | 6/1993 | Salvail et al. | 342/62 |
| 6,222,494 B1 | * | 4/2001 | Erkocevic | 343/790 |

OTHER PUBLICATIONS

U.S. Ser. No. 10/023,229, filed Dec. 14, 2001, entitled "Balun and Groundplanes for Decade Band Tapered Slot Antenna and Method of Making Same", inventors James M. Irion II, et al. (Attorney Docket 004578.1140).

U.S. Ser. No. 10/022,753, filed Dec. 14, 2001, entitled "Slot for Decade Band Tapered Slot Antenna, and Method of Making and Configuring Same", inventors Nicholas A. Schuneman, et al. (Attorney Docket 004578.1193).

U.S. Ser. No. 10/023,800, filed Dec. 14, 2001, entitled "Decade Band Tapered Slot Antenna, and Method of Making Same", inventors Nicholas A. Schuneman, et al. (Attorney Docket 004578.1194).

Schaubert, Daniel H., "Wide–Band Phased Arrays of Vivaldi Notch Antennas", Antenna Laboratory, University of Massachusetts, pp. 1.6 and 1.9–1.12, undated.

Pickles, W. R., et al., "Ultra–Broadband Phased–Array Antenna", U.S. Naval Research Laboratory, pp. 1–6; undated.

(List continued on next page.)

*Primary Examiner*—Don Wong
*Assistant Examiner*—James Clinger
(74) *Attorney, Agent, or Firm*—Baker Botts L.L.P.

(57) ABSTRACT

An antenna element (10) has two dielectric layers (12, 13), which separate three ground planes (17, 18, 21, 22, 23). The three ground planes have respective slots (26, 27, 28), which collectively define a slotline communicating at an inner end with a balun hole (57) that extends through all of the ground planes and dielectric layers. Two capacitive switches (121) are supported within the balun hole, and each have terminals respectively coupled to the same ground plane on opposite sides of the balun hole. The capacitive switches are independently and selectively operated to dynamically vary the impedance characteristic of the overall balun structure that includes the balun hole and two switch assemblies, and which gives the antenna element good electrical performance over a wide bandwidth. The antenna element includes a stripline (36), and a stripline to a slotline transition exists at the end of the slotline adjacent the balun hole.

30 Claims, 4 Drawing Sheets

OTHER PUBLICATIONS

Shin, Joon, et al., "A Parameter Study of Stripline–Fed Vivaldi Notch–Antenna Arrays", IEEE Transactions on Antennas and Propagation, vol. 47, No. 5, May 1999, pp. 879–886.

Chio, Tan–Haut, et al., "Parameter Study and Design of Wide–Band Widescan Dual–Polarized Tapered Slot Antenna Arrays", IEEE Transactions on Antennas and Propagation, vol. 48, No. 6, Jun. 2000, pp. 879–886.

Kragalott, Mark, et al., "Design of a 5 : 1 Bandwidth Stripline Notch Array from FDTD Analysis", IEEE Transactions on Antenna and Propagation, vol. 48, No. 11, Nov. 2000, pp. 1733–1741.

Lee, Hai Fong, et al., "Advances in Microstrip and Printed Antennas", John Wiley & Sons, Inc., New York, 1997, two title pages and pp. 447–453 and 510–514.

Simon, K., "MMIC Compensation Network for Phased Array Element Mismatch", Raytheon Company, Research Division, Sep. 14, 1990, 68 pages.

* cited by examiner

METHOD AND APPARATUS FOR INCREASING BANDWIDTH OF A STRIPLINE TO SLOTLINE TRANSITION

GOVERNMENT RIGHTS STATEMENT

The U.S. Government has a paid-up license in this invention and the right in limited circumstances to require the patent owner to license others on reasonable terms as provided for by the terms of Contract No. MDA972-99-C-0025.

TECHNICAL FIELD OF THE INVENTION

This invention relates in general to techniques for improving bandwidth of devices having a stripline to slotline transition and, more particularly, to techniques for improving bandwidth of antenna elements having a stripline to slotline transition.

BACKGROUND OF THE INVENTION

Various different types of devices include a stripline to slotline transition, one example of which is an antenna element configured for use in a phased array antenna. In one form of such an antenna element, a balun is provided to improve the bandwidth of the antenna element, and communicates with the end of the slotline nearest the region of the stripline to slotline transition.

In the most common existing antenna element of this type, the balun has a predetermined configuration which does not change during normal operation of the antenna element. This type of balun provides good electrical performance within a limited bandwidth, but suffers from electrical performance degradation when used over a relatively wide bandwidth. It is desirable to be able to provide an antenna element which has a relatively wide 10:1 bandwidth, commonly referred to as a "decade" bandwidth. However, known balun structures that can be used to achieve a decade bandwidth have a relatively large physical size. In an array antenna, the spacing between adjacent antenna elements becomes progressively smaller as the highest operational frequency of the antenna increases. Consequently, the space available for each antenna element, often called the unit cell size, is so small in comparison to low frequency wavelengths that the known balun structure capable of providing a decade bandwidth is too big to fit within the unit cell size.

SUMMARY OF THE INVENTION

From the foregoing, it may be appreciated that a need has arisen for a balun structure which is suitable for use with a stripline to slotline transition and which avoids some or all of the disadvantages of pre-existing arrangements.

According to one form of the present invention, a method and apparatus are provided to address this need, and involve operation of an apparatus which includes a conductive section having a recess with a balun portion and an elongate slot portion communicating at one end with the balun portion, and which includes an elongate conductive element extending generally transversely with respect to the slot portion in the region of the one end thereof. The technique includes selectively operating a capacitive element in one of first and second modes in which the capacitive element respectively has first and second capacitances that are substantially different, the capacitive element having first and second terminals which are respectively coupled to the conductive section at spaced first and second locations disposed along a periphery of the balun portion, wherein in the first mode the balun portion and the capacitive element collectively have a first effective impedance, and in the second mode the balun portion and the capacitive element collectively have a second effective impedance different from the first effective impedance.

According to a different form of the present invention, a method and apparatus involve operation of an apparatus which includes a conductive section having a recess with a balun portion and an elongate slot portion communicating at one end with the balun portion, the balun portion having in a radio frequency band an effective impedance which is substantially larger than an effective impedance of the slot portion, and which includes an elongate conductive element which extends generally transversely with respect to the slot portion in the region of the one end thereof. The technique involves selectively operating a switch in one of first and second modes in which the switch respectively is substantially transmissive and substantially non-transmissive to radio frequency signals, the switch having first and second terminals which are respectively coupled to the conductive section at spaced first and second locations disposed along a periphery of the balun portion, wherein in the first mode the balun portion and the switch collectively have a first effective impedance and in the second mode the balun portion and the switch collectively have a second effective impedance different from the first effective impedance, the first and second effective impedances each being substantially larger than the effective impedance of the slot portion.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
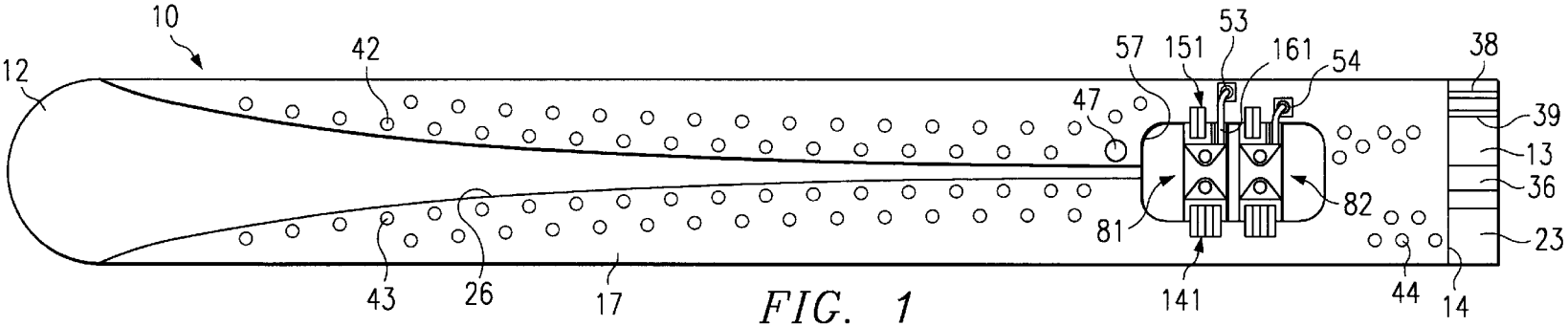
FIG. 1 is a diagrammatic top view of an antenna element which embodies the present invention.

FIG. 1 is a diagrammatic top view of an apparatus which is an antenna element 10, and which embodies the present invention. In the disclosed embodiment, the antenna element 10 is configured for use in a not-illustrated phased array antenna system, where the antenna system includes a plurality of the antenna elements 10 arranged in a two-dimensional array of rows and columns.

Figure 2:
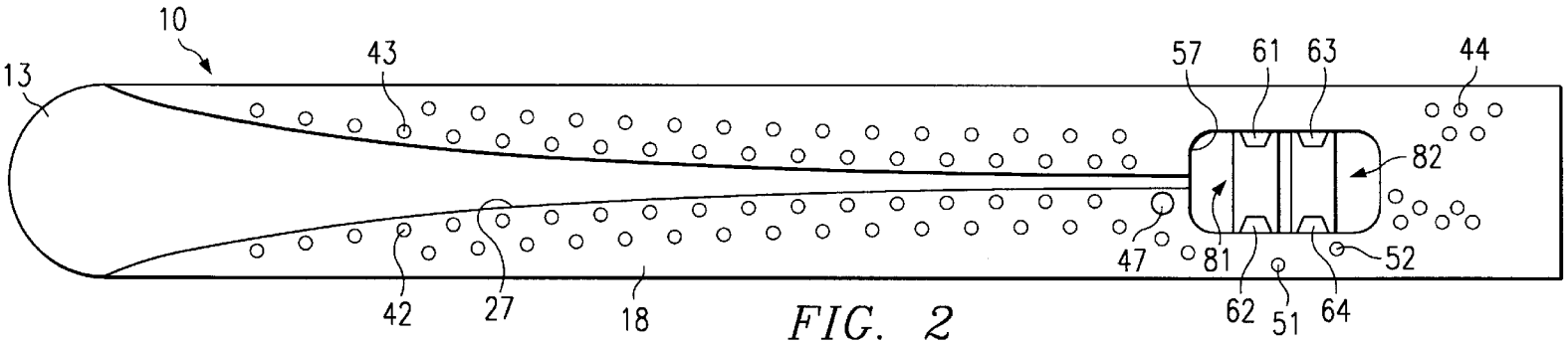
FIG. 2 is a diagrammatic bottom view of the antenna element of FIG. 1.
Figure 3:
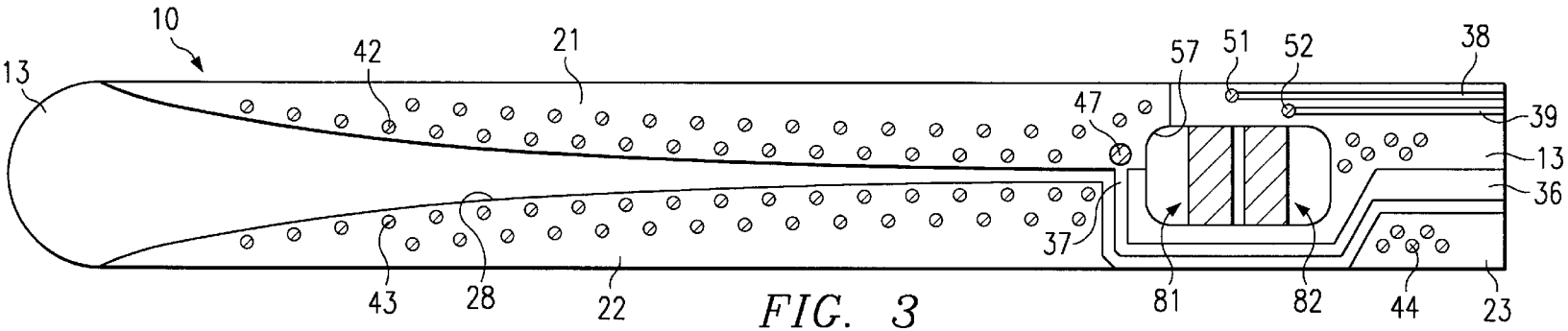
FIG. 3 is a sectional top view of the antenna element of FIG. 1, taken along a center plane of the antenna element.

FIG. 2 is a diagrammatic bottom view of the antenna element 10. The antenna element 10 includes two adjacent and parallel layers 12 and 13 of a dielectric material which, in the disclosed embodiment, has a dielectric constant (Er) of approximately 3.0. In the disclosed embodiment, the dielectric layers 12 and 13 are bonded together by a thin layer of bondfilm of a type well known in the art, but the bondfilm is omitted from the drawings for clarity. FIG. 3 is a sectional top view taken along a central plane of the antenna element which extends between the dielectric layers 12 and 13.

As best seen in FIG. 1, the dielectric layer 12 is slightly shorter than the dielectric layer 13, so that the right end portion of the dielectric layer 13 projects outwardly beyond the right end 14 of the dielectric layer 12. The dielectric layer 12 has on the top side thereof a first ground plane 17 (FIG. 1), the dielectric layer 13 has on the bottom side thereof a second ground plane 18 (FIG. 2), and the dielectric layer 13 has on the top side thereof a third ground plane defined by three separate portions 21, 22 and 23 (FIG. 3). Each of these three ground planes defines a respective slot 26–28, which is flared so as to increase progressively in width in a direction toward the left end of the antenna element 10 in FIGS. 1–3. The slots 26–28 are aligned with each other, and collectively define a slotline.

With reference to FIG. 3, the dielectric layer 13 has on the upper side thereof a conductive strip 36, one end of which is disposed at the right end of the dielectric layer 13. The other end 37 of the conductive strip 36 extends across the right end of the slot 28, and is directly connected to the portion 21 of the center ground plane, which represents an electrical termination of the conductive strip 36. The conductive strip 36 serves as a conductive element of a type which is commonly referred to in the art as a stripline, and carries electromagnetic signals that are being transmitted from or received by the antenna element 10.

The dielectric layer 13 also has on the upper side thereof two further conductive strips 38 and 39, which each have one end disposed at the right end of the dielectric layer 13, and which each extend to a respective via 51 or 52. The vias 51 and 52 extend upwardly through the dielectric layer 12 to respective contact pads 53 and 54 (FIG. 1) provided on the upper side of the dielectric layer 12. These contact pads 53 and 54 are each disposed within an approximately square opening provided in the ground plane 17, so that the pads 53 and 54 are each electrically separate from the ground plane 17.

A plurality of additional vias extend through both of the dielectric layers 12 and 13 at a number of different locations, and electrically couple all of the portions 17–18 and 21–23 of the three ground planes together, in order to avoid parallel plate and waveguide modes from forming in the dielectric material. Three of these vias are identified with reference numerals 42, 43, and 44. Another of these vias is identified by reference numeral 47, and is slightly larger in diameter than the rest of these vias. The via 47 is disposed closely adjacent the point at which the end 37 of the stripline 36 terminates directly into the ground plane portion 21.

A balun hole 57 extends vertically through the entire antenna element 10, and in particular extends through both of the dielectric layers 12 and 13, and through each of the three ground planes thereon. The balun hole 57 is approximately rectangular in shape, except that the corners are slightly rounded. In the disclosed embodiment, the inside edge of the balun hole 57 is plated with metal, in order to help electrically couple the various ground planes to each other, and also for the purpose of limiting electric fields within the balun hole to the region of the balun hole itself, in particular by preventing these fields from extending into the material of the dielectric layers 12 and 13.

As best seen in FIG. 2, the dielectric layer 13 has four ledges or projections 61–64 that each project a short distance into the balun hole 57, the projections 61 and 63 being provided on one side of the balun hole, and the projections 62 and 64 being provided on the other side of the balun hole. The projection 61 is aligned with the projection 62, and the projection 63 is aligned with the projection 64.

Figure 4:
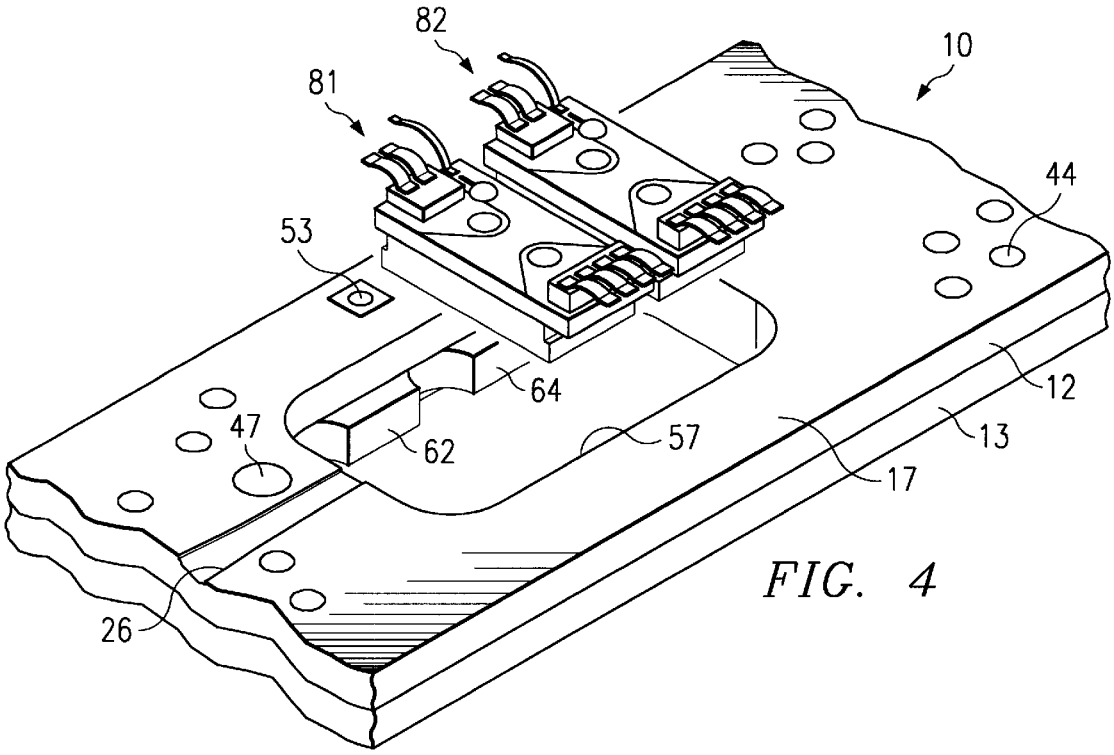
FIG. 4 is a diagrammatic fragmentary exploded perspective view, showing part of the antenna element of FIG. 1 in an enlarged scale.

Two capacitive switch assemblies 81 and 82 are disposed within and extend across the balun hole 57. As discussed later, the switch assembly 81 is supported by the projections 61 and 62 (FIG. 2), and the switch assembly 82 is supported by the projections 63 and 64. FIG. 4 is a diagrammatic exploded fragmentary perspective view of a portion of the antenna element 10 of FIGS. 1–3, showing in an enlarged scale the switch assemblies 81–82 that are supported within the balun hole 57.

The narrow right end of the slotline defined by the slots 26–28 communicates electrically with one side of the balun hole 57. In the disclosed embodiment, this narrow end of the slotline has an impedance of approximately 50Ω in the radio frequency band, the impedance of the slotline increasing progressively from the narrow end thereof to the wide end thereof. If the switch assemblies 81 and 82 are ignored, the balun hole 57 has an impedance of approximately 300Ω in the radio frequency band, as viewed from the end portion 37 of the stripline 36. However, as discussed in more detail later, the switch assemblies 81 and 82 can be used to selectively vary the effective impedance of the overall balun structure, which includes not only the balun hole 57, but also the switch assemblies 81–82. In the region of the end 37 of the stripline 36, the stripline has an impedance of approximately 50Ω in the radio frequency band.

Figure 5:
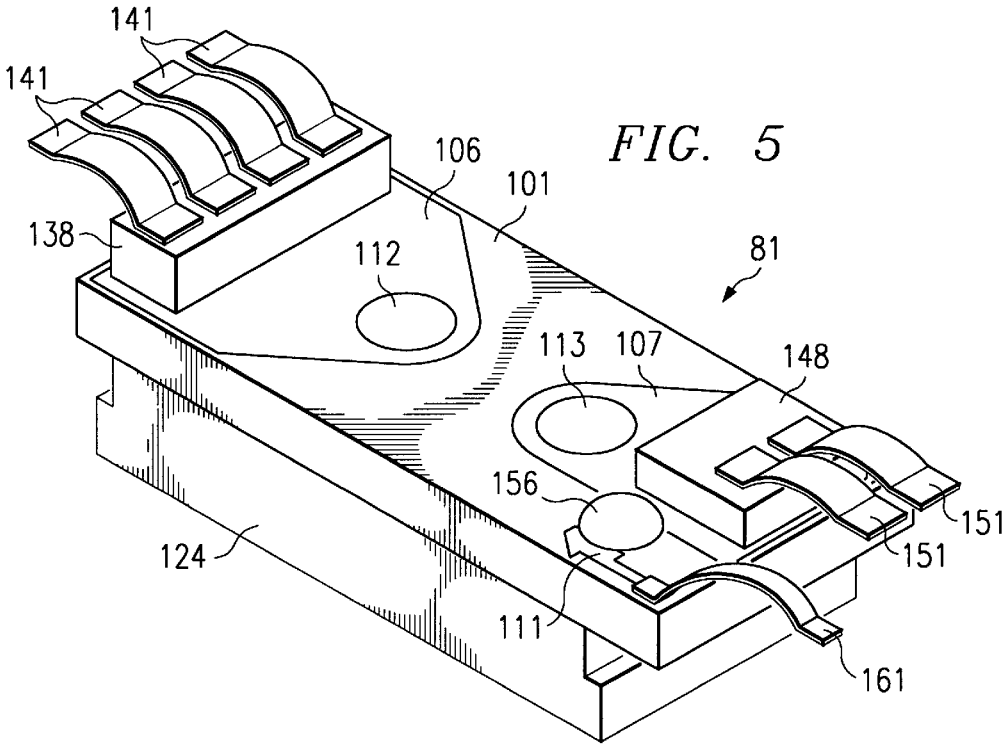
FIG. 5 is a diagrammatic perspective view showing an upper side of a switch assembly which is a component of the antenna element of FIG. 1.
Figure 6:
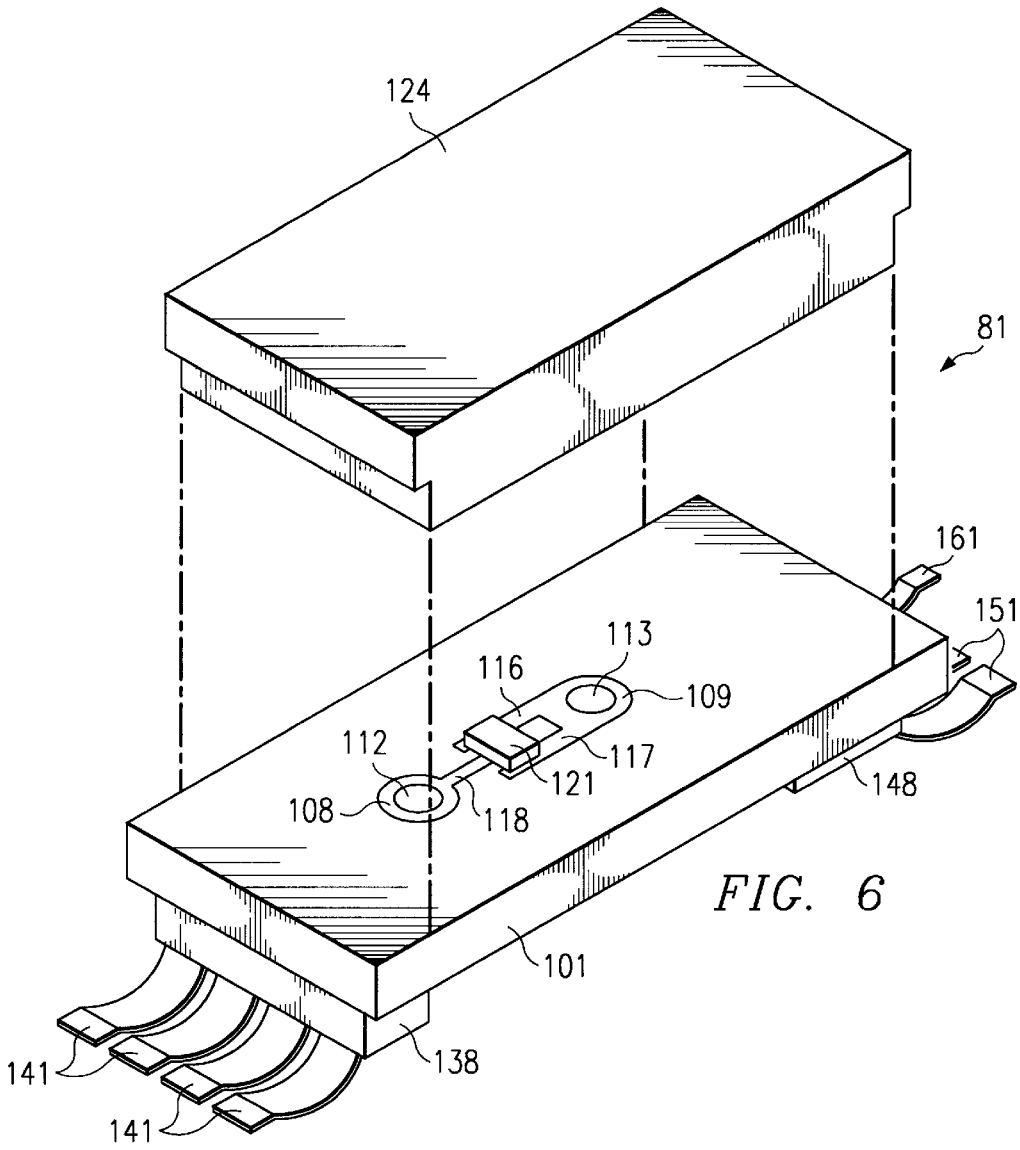
FIG. 6 is a diagrammatic exploded perspective view of a bottom side of the switch assembly of FIG. 5.

In the disclosed embodiment, the switch assemblies 81 and 82 are identical, and therefore only the switch assembly 81 is illustrated and described in detail here. More specifically, FIG. 5 is a diagrammatic perspective view of the top side of the switch assembly 81, and FIG. 6 is a diagrammatic exploded perspective view of the bottom side of the switch assembly 81. Referring to FIGS. 5 and 6, the switch assembly 81 includes an approximately rectangular and platelike substrate 101, which is made of a dielectric material such as alumina or silicon. The outer edge portions of the bottom surface of the substrate 101 respectively engage the projections 61 and 62 (FIGS. 2 and 4), with the provision therebetween of an adhesive such as a suitable known epoxy, which fixedly secures the substrate 101 to the projections 61–62. This adhesive connection serves to fixedly support the entire switch assembly 81 on the two projections 61–62.

Two metalization regions 106 and 107 are provided on the upper side of the substrate 101, and two further metalization regions 108 and 109 are provided on the bottom side of the substrate 101. A further metalization region 111 is provided on the upper side of the substrate 101, a short distance from the region 107. These metalization regions 106–109 and 111 can be formed in any suitable manner, and in the disclosed embodiment are formed by depositing a layer of metal on each side of the substrate 101, and by then carrying out a masked etch of a type known in the art in order to remove portions of each metal layer other than the portions that define the metalization regions 106–109 and 111.

A conductive via 112 extends through a vertical opening provided through the substrate 101, in order to electrically couple the metalization regions 106 and 108. Similarly, a conductive via 113 extends through a vertical opening provided through the substrate 101, in order to electrically couple the metalization regions 107 and 109. As evident from FIG. 5, the metalization regions 106 and 107 each extend outwardly from the associated via 112 or 113 in a direction away from the other thereof. As evident from FIG. 6, the metalization regions 108 and 109 each extend from the associated via 112 or 113 in a direction toward the other thereof. In this regard, the metalization region 109 has two spaced fingers 116 and 117, and the metalization region 108 has one finger 118 which is disposed between the fingers 116 and 117 but which is free from electrical contact therewith. In other words, the fingers 116–118 are interleaved.

With reference to FIG. 6, a micro-electro-mechanical system (MEMS) switch 121 is mounted to the underside of the substrate 101. The switch 121 is a device of a known type, and has two spaced conductive strips therein which are not visible in FIG. 6. One of these two strips is electrically coupled to the finger 118 of the metalization region 108, and the other of these two strips is electrically coupled to both of the fingers 116–117 of the metalization region 109. One of the two strips within the switch 121 is flexible, and can flex so as to move between two positions in which the physical space between the two strips, and thus the capacitance between the two strips, is significantly different. The capacitance in turn determines the degree to which a radio frequency (RF) signal applied to one of the strips will be capacitively coupled to the other thereof, and thus flow through the switch.

In operation, a direct current (DC) bias voltage is applied between the two strips in the switch 121, and is selectively switched between two significantly different values, causing the switch 121 to be selectively operable in either of two distinct modes. In one mode, the capacitive switch 121 appears to be a substantially open circuit in a radio frequency band, and in the other mode the switch 121 appears to be a substantially closed circuit in a radio frequency band.

A lid 124 made of a glass material is sealingly secured by a suitable known adhesive to the underside of the substrate 101, and has on the side thereof facing the substrate 101 a recess which is not visible in the drawings but which receives the switch 121. The recess within the lid 124 contains a vacuum or an inert gas at the time the lid 124 is sealed to the substrate 101. This ensures that the switch 121 operates in a vacuum or inert gas environment within a hermetically sealed chamber defined by the substrate 101 and the lid 124, which in turn reduces the likelihood that the switch 121 will fail prematurely or come to operate improperly.

A transversely extending strip 138 of a metal or other conductive material is formed along the outer edge of the metalization region 106. Four ribbon bonds 141 each have one end bonded to the top surface of the conductive strip 138, and the other end bonded to the ground plane 17 on the dielectric layer 12 (FIG. 1).

A DC blocking capacitor 148 is bonded to the metalization region 107 near an outer edge thereof. The capacitor 148 is a known type of device, which has metal top and bottom layers separated by a center dielectric layer, the metal bottom layer being bonded to the metalization region 107. Two ribbon bonds 151 each have one end bonded to the metal top layer of the capacitor 148, and the other end bonded to the ground plane 17 on the dielectric layer 12 (FIG. 1).

A drop 156 of a carbon-impregnated epoxy is applied to the top surface of the substrate 101, so as to contact both of the metalization regions 107 and 111. After the drop 156 has been allowed to cure and harden, it serves as a resistor which electrically couples the metalization regions 107 and 111. The amount of resistance provided by the drop 156 is a function of the distance between the metalization regions 107 and 111, and the density of carbon in the epoxy. A ribbon bond 161 has one end bonded to the metalization region 111, and its other end bonded to the pad 53 on the dielectric layer 12 (FIG. 1). As discussed above, the pad 53 is electrically coupled through the via 51 to the DC control line 38. Although the disclosed embodiment has only one switch 121 disposed in the switch assembly 81, it will be recognized that two or more of the switches 121 could be provided in series or in parallel with each other within the switch assembly 81.

Figure 7:
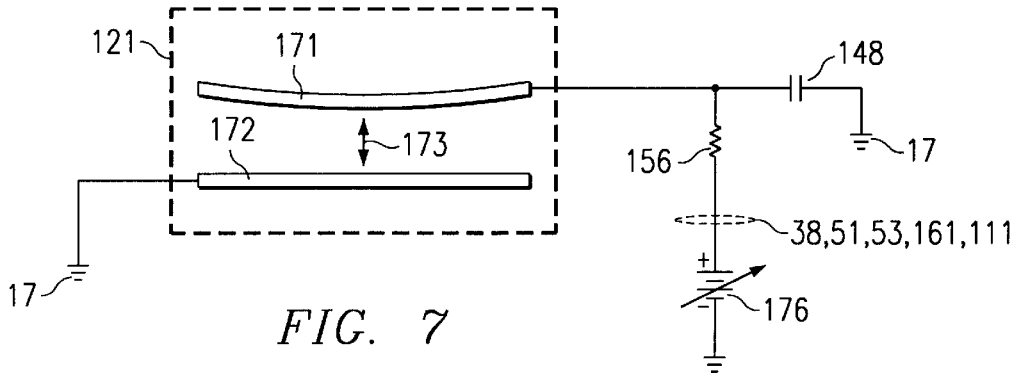
FIG. 7 is a circuit schematic which includes the circuitry present in the switch assembly of FIG. 5.

FIG. 7 is a circuit schematic which includes the circuit implemented by the switch assembly 81 shown in FIGS. 5–6. Reference numerals 171 and 172 designate the two conductive strips within the switch 121, which were discussed above. One of these conductive switches can flex so as to move between two positions relative to the other thereof. In the disclosed embodiment, the strip 171 is the flexible strip, but it would alternatively be possible for the strip 172 to be the flexible strip. Flexing of the strip 171 causes the spacing 173 between the two strips to change between two different values, which in turn causes the effective capacitance between these strips to change between two different values.

The strip 171 is coupled through the capacitor 148 to the ground plane 17, and the strip 172 is coupled to the ground plane 17, as discussed above. FIG. 7 shows a variable DC power supply 176, which is coupled to but is not a part of the antenna element 10 shown in FIGS. 1–3. The variable source 176 is coupled to the conductive strip 171 through the conductive strip 38, via 51, pad 53, ribbon bond 161, metalization region 111 and resistor 156. The DC voltage from the source 176 is applied between the conductive strips 171 and 172. The DC blocking capacitor 148 prevents the positive terminal of the source 176 from being shorted to the same ground that the negative terminal of this source is coupled to. As this DC bias voltage is varied, it causes variation in an electromagnetic attractive force between the strips 171 and 172, which in turn causes flexing of the strip 171 so as to vary the physical spacing 173 between the conductive strips 171 and 172, which in turn causes variation in the capacitance between the strips 171 and 172.

As mentioned above, the source 176 in the disclosed embodiment is configured to be selectively switched between two significantly different voltages, one of which causes the strip 171 to flex so that it is relatively close the strip 172 and effects a high degree of capacitive coupling between them, and the other of which causes the strip 171 to be spaced sufficiently from the strip 172 so that there is virtually no capacitive coupling between them. Thus, the switch 121 has one operational state with sufficient capacitance so that RF signals effectively see a short circuit through the switch 121 and the capacitor 148, and has a different operational state in which the switch 121 effectively appears to be an open circuit to RF signals.

It will be recognized that, if the switch 121 in either or both switch assemblies 81 and 82 is switched to its operational state with a high capacitance, one or both of the switch assemblies 81–82 will effectively add to the overall balun structure a capacitor which extends between opposite sides of the balun hole 57, which in turn will affect the effective impedance of the overall balun structure. Stated differently, the overall balun structure, which includes the balun hole 57 and the switch assemblies 81–82, will produce an effective impedance which varies in dependence on the operational states of the switch assemblies 81–82. As this effective impedance varies, the frequency response of the antenna 10 will vary. In effect, selective switching of the two switches 121 changes the effective electrical size of the balun hole 57, so as to tune the electrical characteristic of the balun hole 57.

Figure 8:
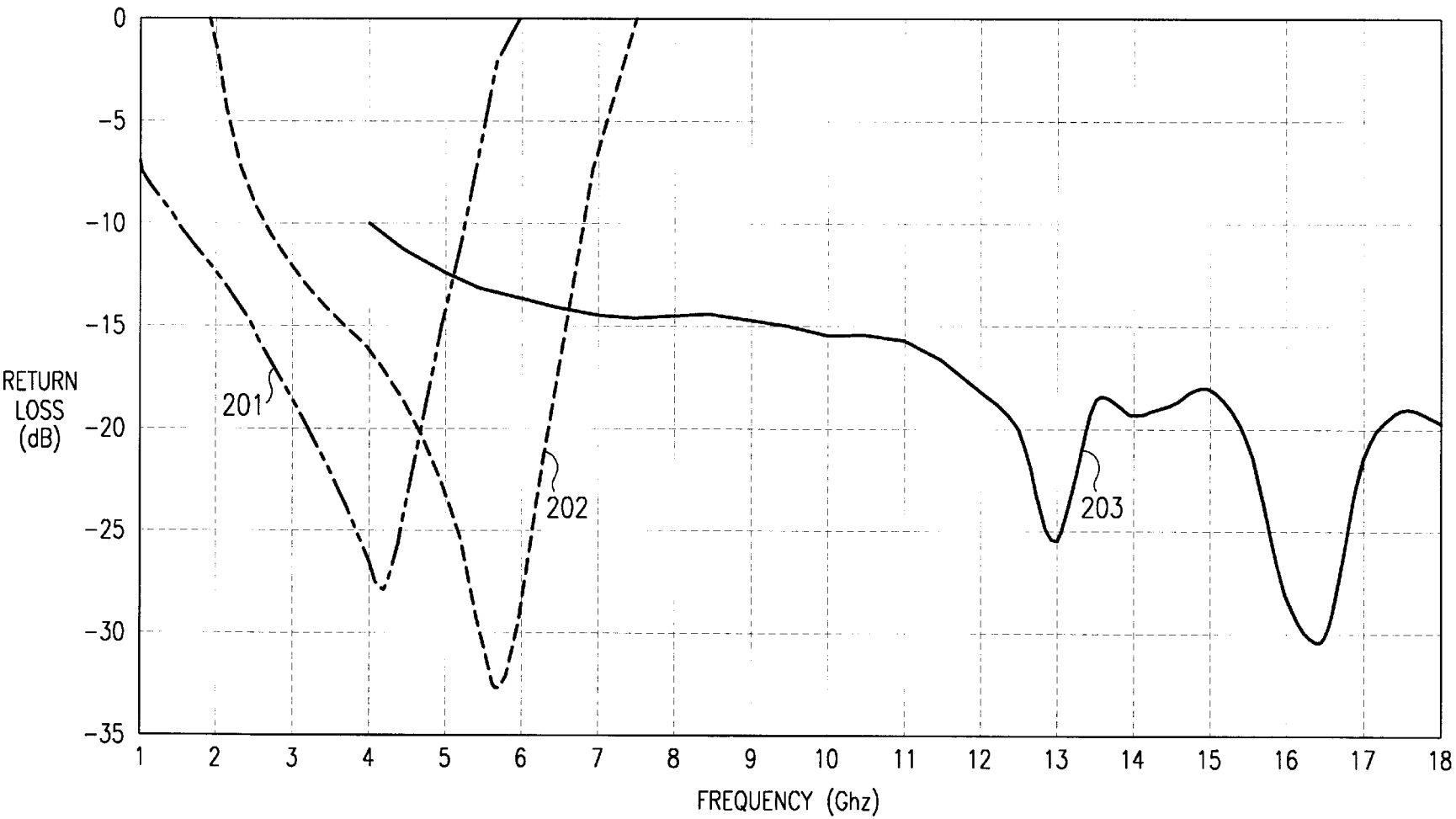
FIG. 8 is a graph showing return loss as a function of frequency for three different operating modes of a balun portion of the antenna element of FIG. 1.

In this regard, FIG. 8 is a graph showing the return loss in decibels (dB) as a function of frequency for the balun portion of the disclosed embodiment. Curve 201 represents the frequency response for return loss when the switches 121 of both switch assemblies 81 and 82 are each in an operational state where they have little or no capacitance. Curve 202 represents the frequency response for return loss when the switch 121 of the switch assembly 81 is in an operational state with little or no capacitance, and the switch 121 of the switch assembly 82 is in the operational state with a higher capacitance. Curve 203 represents the frequency response for return loss when the switches 121 of both switch assemblies 81–82 are in the operational state with a higher capacitance.

It will be noted from FIG. 8 that, by selectively controlling actuation of the switch assemblies 81–82, the balun portion of the disclosed antenna element 10 can provide a performance with a return loss of −10 dB or lower, from a frequency of about 1.6 GHz up to a frequency in excess of 18 GHz. This represents an effective bandwidth in excess of 10:1, with a voltage standing wave ratio (VSWR) less than 2. It will also be noted that, at any given point in time, the disclosed embodiment will be passing frequencies in one subsection of its overall bandwidth while rejecting frequencies in another subsection of its overall bandwidth, in dependence on the current setting of the switch assemblies 81–82.

The present invention provides a number of technical advantages. One such technical advantage results from the capability to use switching technology to dynamically reconfigure the characteristics of a stripline to slotline transition, so as to achieve good electrical performance over a wide frequency bandwidth. A related advantage is that a wide frequency bandwidth in excess of 10:1 can be achieved while maintaining a return loss of −10 dB or lower. A further related advantage results from the use of variable capacitors in the form of capacitive switches, such as micro-electro-mechanical system switches, to effect the dynamic reconfiguration.

Another advantage is that the stripline-to-slotline transition is not only capable of operating over a wide frequency bandwidth, but is also capable of being tuned within this overall bandwidth so as to effectively reject frequencies in certain portions of this overall bandwidth at any given point in time, through appropriate selective actuation of the switches. Stated differently, the stripline-to-slotline transition is capable of operating as a form of selective frequency filter, which can be set to pass frequencies in a first band while rejecting frequencies in a second band, or can be set to pass frequencies in the second band while rejecting frequencies in the first band.

Still another advantage is that the switching technology can be implemented in a manner which requires minimal physical space, so that in the case of an antenna element for an array antenna, the physical size of the switching technology needed for dynamic configuration of frequency response fits within the unit cell size dictated for each antenna element by the highest operational frequency at which the antenna array operates. Yet another advantage is that, where the device with the stripline to slotline transition has a substantial impedance discontinuity between the slotline and the balun, the dynamic reconfiguration occurs in a manner which maintains a substantial impedance discontinuity in all operational modes.

Although one embodiment has been illustrated and described in detail, it will be understood that various substitutions and alterations are possible without departing from the spirit and scope of the present invention, as defined by the following claims.

What is claimed is:

1. An apparatus, comprising:

a conductive section having a recess which includes a balun portion and an elongate slot portion, said slot portion communicating at one end with said balun portion;

an elongate conductive element which extends generally transversely with respect to said slot portion in the region of said one end thereof;

a capacitive element having first and second terminals which are respectively coupled to said conductive section at spaced first and second locations disposed along a periphery of said balun portion, said capacitive element being selectively operable in one of first and second modes in which said capacitive element respectively has first and second capacitances that are substantially different, wherein in said first mode said balun portion and said capacitive element collectively have a first effective impedance and in said second mode said balun portion and said capacitive element collectively have a second effective impedance different from said first effective impedance.

2. An apparatus according to claim 1, wherein in said first mode said first effective impedance causes said balun portion and said capacitive element to pass frequencies in a first frequency band and to reject frequencies in a second frequency band different from said first frequency band; and wherein in said second mode said second effective impedance causes said balun portion and said capacitive element to pass frequencies in said second frequency band and to reject frequencies in said first frequency band.

3. An apparatus according to claim 1, wherein said capacitive element includes a micro-electro-mechanical system switch.

4. An apparatus according to claim 1, including a member which extends across said balun portion and which has opposite ends supported on opposite sides of said balun portion in the region of said first and second locations, said capacitive element being supported on said member.

5. An apparatus according to claim 4, including first and second ledge portions disposed on opposite sides of said balun portion, said ends of said member being fixedly secured to said ledge portions.

6. An apparatus according to claim 4, wherein said member includes a substrate having first and second conductive portions on one side thereof and having third and fourth conductive portions on an opposite side thereof, and includes a first via which couples said first and third conductive portions and a second via which couples said second and fourth conductive portions, said first and second terminals of said capacitive element being respectively coupled to said first and second conductive portions; and including a first conductive bond element which couples said third conductive portion to said first location and a second conductive bond element which couples said fourth conductive portion to said second location.

7. An apparatus according to claim 6, wherein said capacitive element includes a micro-electro-mechanical system switch;

including a lid sealingly coupled to said substrate in a manner so that said switch is disposed within a hermetically sealed chamber between said substrate and said lid;

including a bias capacitor coupled in series with said first conductive bond element;

including a conductive strip separate from said conductive section; and including a conductive bond element and a resistor which are coupled in series with each other between said conductive strip and said third conductive portion.

8. An apparatus according to claim 1, including a further capacitive element having first and second terminals which are respectively coupled to said conductive section at spaced third and fourth locations disposed along a periphery of said balun portion, said further capacitive element being selectively operable independently of the other capacitive element in one of first and second modes in which said further capacitive element respectively has third and fourth capacitances that are substantially different.

9. An apparatus according to claim 8, wherein said apparatus is operable over a frequency range having a bandwidth of at least 10:1.

10. An apparatus according to claim 8, wherein said balun portion and said capacitive elements collectively have substantially said first effective impedance when both of said capacitive elements are operating in said first mode thereof;

wherein said balun portion and said capacitive elements collectively have substantially said second effective impedance when said further capacitive element is operating in said first mode thereof and the other capacitive element is operating in said second mode thereof; and wherein said balun portion and said capacitive elements collectively have a third effective impedance when both of said capacitive elements are operating in said second mode thereof.

11. An apparatus according to claim 1, including an antenna element having as respective portions thereof said conductive section, said elongate conductive element, and said capacitive element; and wherein said slot portion has a section which increases progressively in width in a direction away from said balun portion.

12. A method of operating an apparatus which includes a conductive section having a recess with a balun portion and an elongate slot portion that communicates at one end with said balun portion, and which includes an elongate conductive element extending generally transversely with respect to said slot portion in the region of said one end thereof, said method including the step of:

selectively operating a capacitive element in one of first and second modes in which said capacitive element respectively has first and second capacitances that are substantially different, said capacitive element having first and second terminals which are respectively coupled to said conductive section at spaced first and second locations disposed along a periphery of said balun portion, wherein in said first mode said balun portion and said capacitive element collectively have a first effective impedance, and in said second mode said balun portion and said capacitive element collectively have a second effective impedance different from said first effective impedance.

13. A method according to claim 12, wherein said selectively operating step includes the steps of:

causing said balun portion and said capacitive element to use said first effective impedance in said first mode to pass frequencies in a first frequency band and reject frequencies in a second frequency band different from said first frequency band; and causing said balun portion and said capacitive element to use said second effective impedance in said second mode to pass frequencies in said second frequency band and reject frequencies in said first frequency band.

14. A method according to claim 12, including the step of selectively operating a further capacitive element independently of the other capacitive element in one of first and second modes in which said further capacitive element respectively has third and fourth capacitances that are substantially different, said further capacitive element having first and second terminals which are respectively coupled to said conductive section at spaced third and fourth locations disposed along a periphery of said balun portion.

15. A method according to claim 14, wherein said steps of selectively operating said capacitive elements are carried out so that said balun portion and said capacitive elements collectively have substantially said first effective impedance when both of said capacitive elements are operating in said first mode thereof, said balun portion and said capacitive elements collectively have substantially said second effective impedance when said further capacitive element is operating in said first mode thereof and the other capacitive element is operating in said second mode thereof, and said balun portion and said capacitive elements collectively have a third effective impedance when both of said capacitive elements are operating in said second mode thereof.

16. An apparatus, comprising:

a conductive section having a recess which includes a balun portion and an elongate slot portion, said slot portion communicating at one end with said balun portion, wherein said balun portion has, in a radio frequency band, an effective impedance which is substantially larger than an effective impedance of said slot portion;

an elongate conductive element which extends generally transversely with respect to said slot portion in the region of said one end thereof;

a switch having first and second terminals which are respectively coupled to said conductive section at spaced first and second locations disposed along a periphery of said balun portion, said switch being selectively operable in one of a first mode in which said switch is substantially transmissive to radio frequency signals and a second mode in which said switch is substantially non-transmissive to radio frequency signals, wherein in said first mode said balun portion and said switch collectively have a first effective impedance and in said second mode said balun portion and said switch collectively have a second effective impedance different from said first effective impedance, said first and second effective impedances each being substantially larger than said effective impedance of said slot portion.

17. An apparatus according to claim 16, wherein in said first mode said first effective impedance causes said balun portion and said switch to pass frequencies in a first frequency band and to reject frequencies in a second frequency band different from said first frequency band; and wherein in said second mode said second effective impedance causes said balun portion and said switch to pass frequencies in said second frequency band and to reject frequencies in said first frequency band.

18. An apparatus according to claim 16, wherein said switch includes a micro-electro-mechanical system switch.

19. An apparatus according to claim 16, including a member which extends across said balun portion and which has opposite ends supported on opposite sides of said balun portion in the region of said first and second locations, said switch being supported on said member.

20. An apparatus according to claim 19, including first and second ledge portions disposed on opposite sides of said balun portion, said ends of said member being fixedly secured to said ledge portions.

21. An apparatus according to claim 19, wherein said member includes a substrate having first and second conductive portions on one side thereof and having third and fourth conductive portions on an opposite side thereof, and includes a first via which couples said first and third conductive portions and a second via which couples said second and fourth conductive portions, said first and second terminals of said switch being respectively coupled to said first and second conductive portions; and including a first conductive bond element which couples said third conductive portion to said first location and a second conductive bond element which couples said fourth conductive portion to said second location.

22. An apparatus according to claim 21, wherein said switch includes a micro-electro-mechanical system switch;

including a lid sealingly coupled to said substrate in a manner so that said switch is disposed within a hermetically sealed chamber between said substrate and said lid;

including a bias capacitor coupled in series with said first conductive bond element;

including a conductive strip separate from said conductive section; and including a conductive bond element and a resistor coupled in series with each other between said conductive strip and said third conductive portion.

23. An apparatus according to claim 16, including a further switch having first and second terminals which are respectively coupled to said conductive section at spaced third and fourth locations disposed along a periphery of said balun portion, said further switch being selectively operable independently of the other switch in one of a first mode in which said switch is substantially transmissive to radio frequency signals and a second mode in which said further switch is substantially non-transmissive to radio frequency signals.

24. An apparatus according to claim 23, wherein said apparatus is operable over a frequency range having a bandwidth of at least 10:1.

25. An apparatus according to claim 23, wherein said balun portion and said switches collectively have substantially said first effective impedance when both of said switches are operating in said first mode thereof;

wherein said balun portion and said switches collectively have substantially said second effective impedance when said further switch is operating in said first mode thereof and the other switch is operating in said second mode thereof; and wherein said balun portion and said switches collectively have a third effective impedance when both of said switches are operating in said second mode thereof, said third effective impedance being substantially larger than said effective impedance of said slot portion.

26. An apparatus according to claim 16, including an antenna element having as respective portions thereof said conductive section, said elongate conductive element, and said switch; and wherein said slot portion has a section which increases progressively in width in a direction away from said balun portion.

27. A method of operating an apparatus which includes a conductive section having a recess with a balun portion and an elongate slot portion that communicates at one end with said balun portion, said balun portion having in a radio frequency band an effective impedance which is substantially larger than an effective impedance of said slot portion, and which includes an elongate conductive element which extends generally transversely with respect to said slot portion in the region of said one end thereof, said method including the step of:

selectively operating a switch in one of first and second modes in which said switch respectively is substantially transmissive and substantially non-transmissive to radio frequency signals, said switch having first and second terminals which are respectively coupled to said conductive section at spaced first and second locations disposed along a periphery of said balun portion, wherein in said first mode said balun portion and said switch collectively have a first effective impedance and in said second mode said balun portion and said switch collectively have a second effective impedance different from said first effective impedance, said first and second effective impedances each being substantially larger than said effective impedance of said slot portion.

28. A method according to claim 27, wherein said selectively operating step includes the steps of:

causing said balun portion and said switch to use said first effective impedance in said first mode to pass frequencies in a first frequency band and reject frequencies in a second frequency band different from said first frequency band; and causing said balun portion and said switch to use said second effective impedance in said second mode to pass frequencies in said second frequency band and reject frequencies in said first frequency band.

29. A method according to claim 27, including the step of selectively operating a further switch independently of the other switch in one of first and second modes in which said further switch is substantially transmissive and substantially non-transmissive to radio frequency signals, said further switch having first and second terminals which are respectively coupled to said conductive section at spaced third and fourth locations disposed along a periphery of said balun portion.

30. A method according to claim 27, wherein said steps of selectively operating said switches are carried out so that said balun portion and said switches collectively have substantially said first effective impedance when both of said switches are operating in said first mode thereof, said balun portion and said switches collectively have substantially said second effective impedance when said further switch is operating in said first mode thereof and the other switch is operating in said second mode thereof, and said balun portion and said switches collectively have a third effective impedance when both of said switches are operating in said second mode thereof, said third effective impedance being substantially larger than said effective impedance of said slot portion.

* * * * *